US006182331B1

(12) United States Patent
Hessenthaler

(10) Patent No.: US 6,182,331 B1
(45) Date of Patent: Feb. 6, 2001

(54) SEQUESTERED PIN BOX HINGE AND MORTISING JIG FOR HINGE INSTALLATION

(76) Inventor: George D. Hessenthaler, 560 Vons Way, Providence, UT (US) 84332

( * ) Notice: Under 35 U.S.C. 154(b), the term of this patent shall be extended for 0 days.

(21) Appl. No.: 09/188,804

(22) Filed: Nov. 9, 1998

(51) Int. Cl.[7] ..... E05D 5/02

(52) U.S. Cl. ..... 16/387; 16/386; 16/368; 16/272; 16/265; 403/119; 403/164

(58) Field of Search ..... 16/387, 224, 265, 16/272, 900, 368, 221, 382, 384, 386; 43/12; 403/119, 164, 161, 165; 248/291.1, 289.1, 292.12

(56) References Cited

U.S. PATENT DOCUMENTS

| | | | | |
|---|---|---|---|---|
| 193,633 | | 7/1877 | Beaudet . | |
| 423,247 | | 3/1890 | Hastings . | |
| 629,185 | | 7/1899 | Arnold . | |
| 1,528,838 | | 3/1925 | Mayr . | |
| 1,692,785 | * | 11/1928 | Parsons | 16/272 |
| 2,085,631 | * | 6/1937 | Burdick | 16/272 |
| 2,748,420 | * | 6/1956 | Clover | 16/265 |
| 3,349,427 | | 10/1967 | Cairns et al. . | |
| 4,882,809 | * | 11/1989 | Uppstrom | 16/384 |
| 5,167,049 | | 12/1992 | Gibbs . | |
| 5,172,452 | | 12/1992 | Brown . | |
| 5,217,315 | * | 6/1993 | Rosane | 403/119 |
| 5,380,113 | * | 1/1995 | Boehm | 43/12 |
| 5,412,843 | | 5/1995 | Krongauz et al. . | |

OTHER PUBLICATIONS

Pp. 132–133 of Lee Valley 1996/97 Catalog.
Admitted prior art hinges made by Ludwig Industries of N.Y.

* cited by examiner

*Primary Examiner*—Chuck Y. Mah
(74) *Attorney, Agent, or Firm*—John S. Pratt; Kilpatrick Stockton LLP

(57) ABSTRACT

The invention is a box hinge comprising a pair of identical hinge members pivotably secured by a sequestered pin captured within a bore in each hinge member. The identical hinge members are cylindrical with a rounded end from which a spherical quadrant has been removed and which has been partially and centrally bored. Each bore extends perpendicular to the longitudinal axis of the hinge member and perpendicular to the plane defined by the flat surface of the remaining spherical quadrant. The pin box hinge is formed by inserting one half of the sequestered pin in the bore of each hinge member such that the flat surfaces of both spherical quadrants are coplanar. In an alternative embodiment, the pin sequestration bores are coaxial with the longitudinal axis of the hinge members, which rotate about that longitudinal axis. Jigs for preparing boxes and lids to receive the hinges, and methods of installation, are also disclosed.

7 Claims, 2 Drawing Sheets

SEQUESTERED PIN BOX HINGE AND MORTISING JIG FOR HINGE INSTALLATION

FIELD OF THE INVENTION

This invention relates to hinges and techniques and devices for installing them in cases or boxes.

BACKGROUND OF THE INVENTION

Small cases or boxes for jewelry, stationary, cigars, fishing flies and the like have long used hinges for attaching case tops and bottoms. It is desirable for such hinges to be attractive, consistently functional, economical, and easy to install in small wooden cases with relatively little effort and cost.

Hinges for this purpose typically use a pair of dowel-like hinge members joined by a pin or rivet extending completely through the members to provide a hinge axis about which the members pivot. The two dowel-like members usually have different but complementary shapes that are secured by a fastener or rivet extending completely through an aperture in each hinge member. For example, the first hinge member may have a cylindrical head from which a rectangular section has been removed. The second hinge member would then have a rectangular head of substantially the same dimensions as the rectangular section removed from the first hinge member. The head of one member is received in the recessed portion of the second member, and a fastener extends through both members.

This hinge design has several disadvantages. It is expensive to manufacture because two different hinge members are needed. Because the hinge members are different, additional installation time is required to ensure proper and consistent orientation of adjacent hinges. Other problems arise where the fastener extends completely through the hinge members and remains visible. A visible fastener often detracts from the beauty of the hinge. A solution to this aesthetic problem has been to grind down the protruding fastener until it is flush with the hinge surface. This is unsatisfactory however, because in addition to the extra manufacturing cost, grinding down the fastener can mar the hinge member.

In a more recent example of the general dowel-like hinge design used for small wooden cases, a pair of identical hinge members are secured together by a fastener extending completely through an aperture in each hinge member. Similar disadvantages exist for this hinge design as well. Although only one type of hinge member needs to be manufactured, additional operations are required to fasten the two identical hinge members together. For instance, the aperture in one of the hinge members would need to be enlarged to properly secure the two hinge members with a fastener. The fastener also needs to be counter-sunk in hinge members. All of these machining operations increase the cost of manufacturing this type of hinge. In addition, the aesthetic problems previously described with respect to the fastener extending completely through the hinge body have not been addressed.

In the design and manufacturing of small wooden cases, it is desirable to drill blind holes or mortises in the case so the hinge members may be partially inserted into the case top and bottom to enable the lid to close tightly, as well as make the hinge installation attractive. This can be accomplished by marking the hinge location on the case top and case bottom and cutting or drilling a mortise at each location so the hinge member can be inserted into the case wall. This method is time consuming, requires substantial skill, and often results in hinge members that are mis-aligned, which causes case tops to open unsatisfactorily.

Another method has been to drill a hole nearly the entire vertical length of the case through the bottom of the case prior to separating the case into a top and bottom portion. Then the case is sawed in two at the case parting line separating the top from the bottom. Because of the length of the hole or mortise required by this method, the drill often wanders. When this occurs, the case wall is weakened or may even be pierced. In addition, two or more hinges installed in this manner may be mis-aligned.

For the reasons explained above, there is a need for a hinge that is attractive, economical, consistently functional, and that may be installed in small wooden cases with relatively little effort and cost. There is also a need for an apparatus for efficiently and accurately forming blind holes or mortises in cases for inserting hinge members.

SUMMARY OF THE INVENTION

This invention is a pin-type box hinge that satisfies the need for a functional, aesthetic, and economical hinge that may be installed in small wooden boxes and cases with relatively little effort and cost. The pin box hinge uses at least one pair of identical hinge members pivotably joined by a sequestered pin captured within a blind or stopped bore in each hinge member. The identical hinge members are cylindrical with semi-spherical radiused or domed ends from which one half of the dome has been removed to a depth equal to the diameter of the hinge member, dividing the dome along the longitudinal axis of the cylinder, leaving a half-dome with a flat face. The blind bore is centered in that face. Each bore extends perpendicular to the longitudinal axis of the hinge member and normal to the flat surface of the remaining half dome. The box hinge captures one half of a pin in the bore of each hinge member such that the flat surfaces of both half domes or spherical quadrants are coplanar. Because the pivot pin is not secured to the hinge members, hinges may be separated and the box lid removed if the hinges have been installed so that hinge members in the lid face in the same direction.

In an alternative embodiment, the pin sequestration bores are coaxial with the longitudinal axis of the hinge members, which rotate about that longitudinal axis. This provides a functionally very similar, but visually somewhat different hinge.

Hinge mortising jigs align the case top and bottom for drilling to accept pin box hinge members. One jig is a rectangular top plate having two drill guides and three parallel, spaced plates depending perpendicularly from the top plate. The two outer plates each have a threaded hole for receiving a fastener screw to clamp box sides in the jig and a pin hole for receiving a pin marker punch. The center plate acts as a fence or guide against which the back walls of the box and lid are pressed to position them correctly relative to the drill guides. The two drill guides are located in the center of the top plate, so that each is positioned between the center and one of the outer depending plate.

An alternative embodiment of the jig facilitates drilling holes needed for installation screws that secure hinge members that rotate along their longitudinal axis. This jig can be formed from an extruded or machined length of bar stock an inner plate and an outer plate parallel to each other and separated by a generally perpendicular web. Thumb screws hold the jig in position on box members so that holes may be drilled at 45 degree (or other appropriate) angles through the box back and lid by guiding a drill through the jig.

It is therefore an object of this invention to provide a functional and attractive hinge for attaching lids to boxes and cases that may be installed with relatively little effort and cost.

It is an additional object of the present invention to provide a hinge with easily separated sides.

It is an additional object of the present invention to provide hinge mortising and drilling jigs that decrease the time required to install hinges and increases the accuracy with which they may be installed.

DETAILED DESCRIPTION OF THE DRAWINGS

Figure 6:
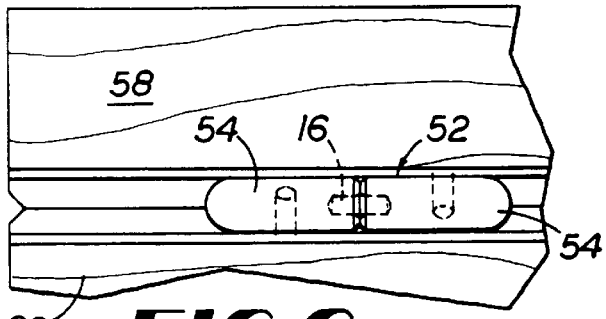
FIG. 6 is a rear elevation view of a portion of box components within which an alternative embodiment of the hinge of this invention is installed.
Figure 9:
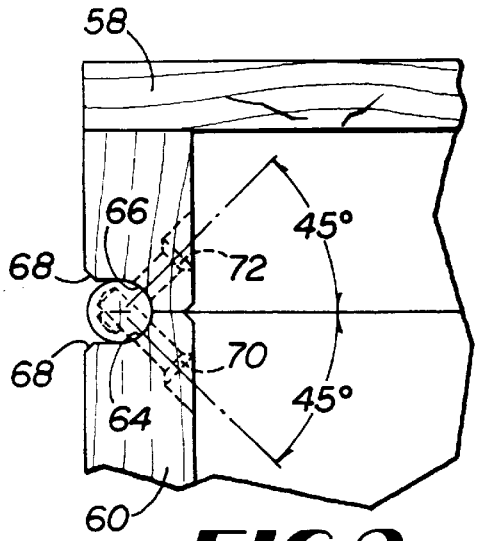

FIG. 9 an end elevation view of a portion of a box within which the hinge shown in FIG. 6 has been installed.

Figure 10:
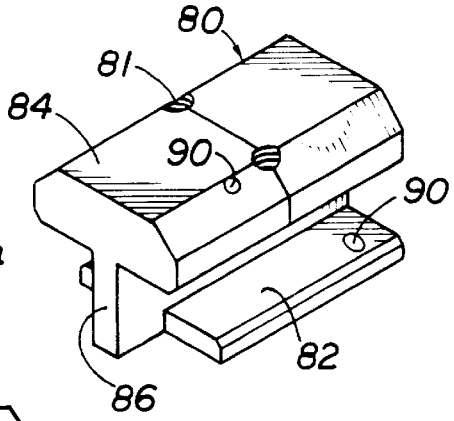
Figure 7:
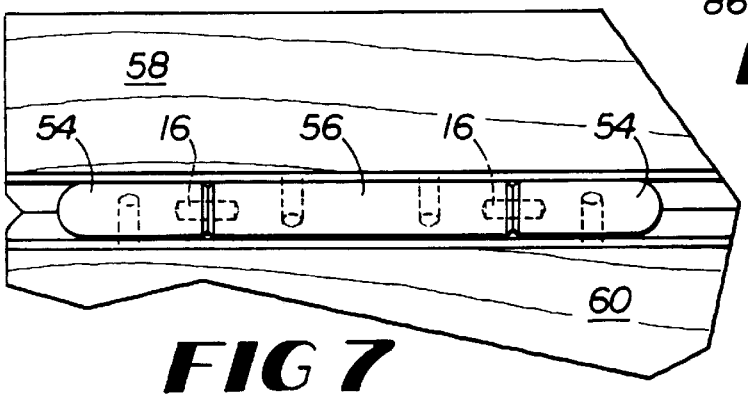
FIG. 7 is a view similar to FIG. 6 showing a second alternative embodiment of the hinge of this invention.
Figure 8:
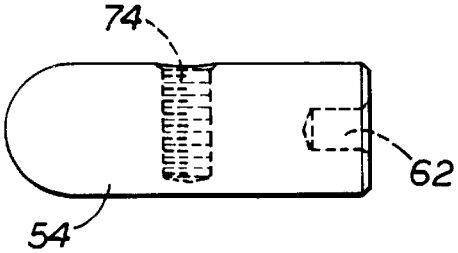
FIG. 8 is a side view of a hinge member of the second and third alternative embodiments of the hinge of this invention.

FIG. 10 is a perspective view of a second embodiment of the hinge installation jig of the present invention.

Figure 11:
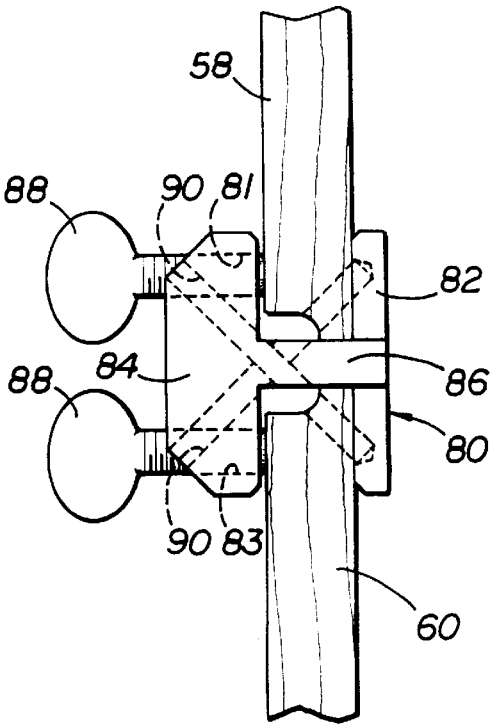

FIG. 11 is an end elevation view of the installation jig shown in FIG. 10 positioned for use on a box lid and back wall.

DETAILED DESCRIPTION OF THE DRAWINGS

Figure 1:
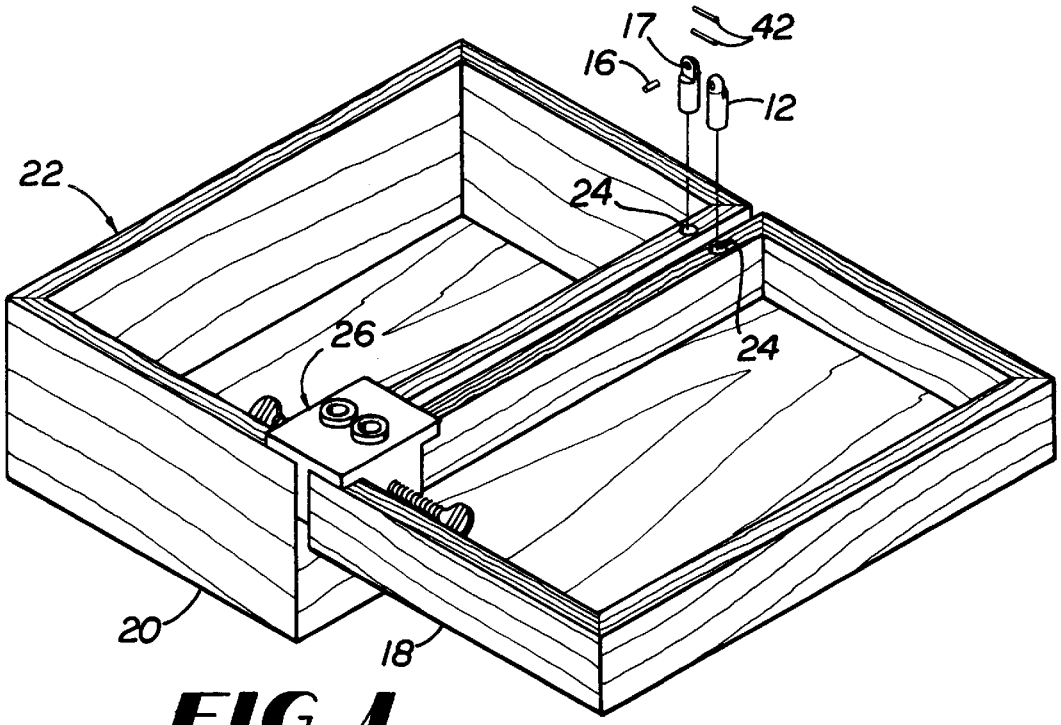
FIG. 1 is a perspective view of a small box with components of the hinge of this invention shown exploded away from the box and with the hinge installation jig of this invention shown in position on the box.
Figure 2:
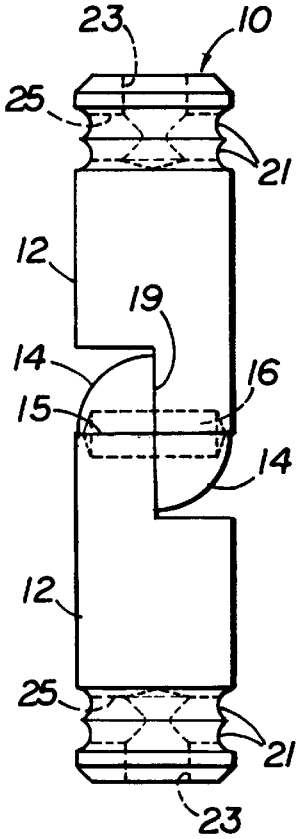
FIG. 2 is an enlarged side elevation view of the hinge of this invention.
Figure 5:
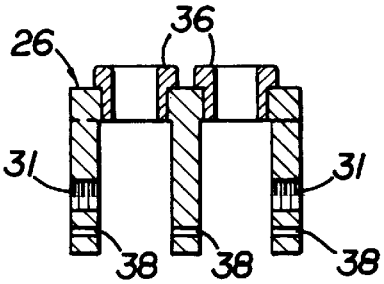
FIG. 5 is an end elevation view, in section, of the hinge installation jig of this invention.
Figure 4:
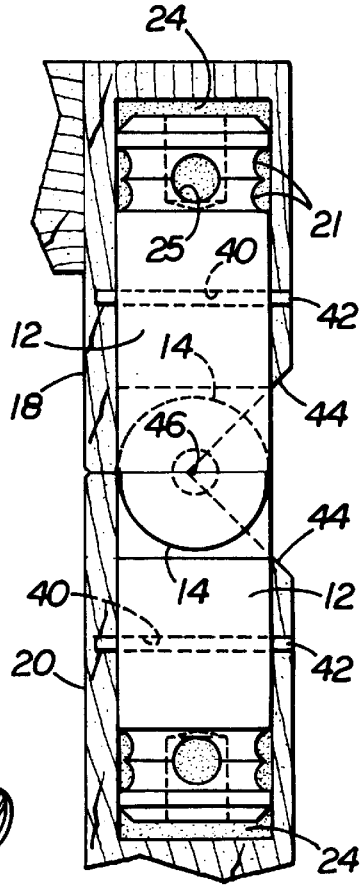
FIG. 4 is a side elevation view of portions of a box lid and bottom within which the hinge of this invention has been installed.

As is illustrated in FIGS. 1, 2 and 4, hinge 10 has two hinge members 12 that pivot relative to each other on a "sequestered" or captured pin 16. Each hinge member 12 may be manufactured identically from a section of round rod so that it is generally cylindrical with a hemispherical or half-dome end from which one-half of the dome has been removed to a depth approximately equal to the rod diameter, leaving a half dome 14. The pin 16 is positioned in a blind bore 17 in planar face 19 of each half dome 14.

In order accurately to position the hinge members 12 in a box 22 having a lid 18 and bottom 20, it is necessary to drill or otherwise form accurately positioned blind bores 24 in the lid 18 and bottom 20. This may be accomplished utilizing a drilling jig 26, as is illustrated in FIG. 1.

Drilling jig 26 is manufactured from a section of extruded aluminum channel having the cross-sectional shape of a capital letter "E.". The jig 26 includes a top plate 28 from which there depend at right angles a centered plate or fence 30 and two outer plates 32. Top plate 28 carries two hardened steel drill guide bushings 36 located on opposite sides of, and equally distant from, center plate 30 to receive a drill of appropriate diameter to form a hole to snugly receive a hinge member 12.

Figure 3:
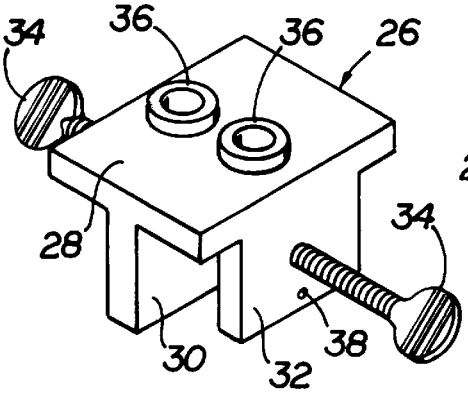
FIG. 3 is a perspective view of the hinge installation jig of this invention.

Each of the outer plates 32 are penetrated by a threaded hole 31 that receives a thumb screw 34 which is preferably nylon or another plastic material to reduce marring of the box component it contacts. When jig 26 is positioned for use, thumb screws 34 press lid 18 and bottom 20 securely against center plate 30. If this is done with lid 18 and bottom 20 aligned with each other (as illustrated in FIG. 1) drill bushings 36 will be properly position for a drill inserted through each bushing 36 to drill aligned bores 24 in the correct positions on lid 18 and bottom 20. By keeping plates 32 narrow (best seen in FIG. 3, jig 26 can be used to position box hinge 10 near the sides of the box. Each of center plate 30 and outer plates 32 are penetrated by marking holes 38 that are aligned with each other and are in the same vertical plane as drill bushings 36.

With one of lid 18 or bottom 20 removed, a marking pin, such as a six penny nail, may be inserted through the holes 38 in one of the outer plates 32 and center plate 30 to locate the position for a hole 40 drilled through the lid or bottom, as the case may be, and into in the member 12. As is shown in FIG. 4, a pin 42, such as a six penny nail, may be inserted in hole 40 in order to lock hinge member 12 in the lid 18 or bottom 20 within which it is positioned. Adhesive may also be used in order to secure the hinge member 12 within the bore 24 in which it is positioned.

In order to enhance the ability of adhesives to hold members 12 in place in box back 20 and lid 18, each member 12 has two annular depressions or channels 21 and a coaxial hole 23 and a transverse hole 25. An expanding adhesive, such as a urethane glue like Gorilla Glue™, will expand into holes 23 and 25 and depression 21, locking member 12 in place. Other glues are also usable.

Transverse hole 25 is generally parallel to pin 16, which means that hole 25 will be generally parallel to the faces of the box 22 members in which it is installed. This insures that any hole 40 (see FIG. 4) will receive a locking pin 42 snugly.

Hinge members 12 of hinge 10 are preferably made from solid brass. Sequestered pin 16 is preferably a stainless steel pin cut, far instance, from stainless steel welding rod. As will be understood by those skilled in the art, hinge members 12 and sequestered pin 16 can be made of other materials, and the dimensions of the components of hinge 10 may be varied and modified without departing from the scope of the present invention as described in the preceding text, the accompanying drawings, and the following claims.

FIG. 1 illustrates a box 20 utilizing two hinges 10. Two hinges 10 are normally adequate for small boxes, but larger boxes will benefit from the use of three or more hinges 10. As will be appreciated by reference to FIG. 2, if the upper hinge member 12 of multiple hinges 10 are all positioned with their half domes 14 on the same side, then a lid 18 may be removed from the bottom 20 within which such hinges 10 are located simply by moving the lid in the direction of that side. This permits hinges 10 to be used in a configuration permitting a box lid easily to be removed. As will likewise be appreciated, if at least one upper hinge member 12 in a box having multiple hinges 10 is faced in the opposite direction from the other hinge members 12, that lid 18 will not be removable from the box bottom 20 with which such hinges 10 are used.

As will be appreciated by reference to FIG. 4, it is often desirable to install hinges 10 with a chamfer 44 on each of lid 18 and bottom 20. This chamfer is positioned to intersect with the longitudinal axis of pins 16, thus allowing lid 18 to pivot clockwise in FIG. 4 about pivot axis 46 (which in the axis of sequestered pins 16) until the chamfers 44 contact each other, thus stopping further opening of lid 18. If the chamfers 44 are essentially 45 degree chamfers, they will permit lid 18 to open approximately 90 degrees, 95 degrees being preferable.

Hinge members 12 may be manufactured with indicia of the depth to which the first of a pair of hinge members 12 should be inserted. For instance a small grove may be formed on the surface of hinge member 12. Alternatively, as illustrated in FIG. 2, the dome from which half-dome 14 is formed may be formed about 0.005 inch smaller than the diameter of the cylindrical portion of hinge member 12. This creates an optical alignment line 15 that acts as a guide in determining how deep to press the first hinge member 12 into the hole receiving it.

An alternative embodiment of the hinge of invention is illustrated in FIGS. 6,7, 8 and 9.

In this horizontal sequestered pin hinge 52, identical end members 54 are affixed to a box lid 50 and box back 60 respectively or, vice versa. A pin 16 is captured within a coaxial hole 62 in each of the hinge end members 54. As will be appreciated by reference to FIG. 7, horizontal end hinge members 54 can be separated by any number of double ended intermediate hinge members 54. Thus, for instance, it is possible to provide a horizontal hinge 52 that is continuous along the entire length of a box 22.

As will be appreciated by reference to FIG. 9, hinge members 52 and 56 rest in an arcuate groove 64 in the box back 60 and a similar groove 66 in the box lid 50. The arcuate groove 64 can be cut with a router and a bullnose bit that cuts an arcuate cove. Portions of the back 60 and lid 50 that extend beyond hinge members 54 and 56 may be relieved with a chamfer 68. Contact between these chamfers 68 on the back 60 and lid 50 will provide a stop to permit lid 58 to rotate open approximately 95 degrees.

As can also be seen in FIG. 9, holes 70 and 72 need to be drilled in box back 60 and lid 50 for screws (not shown) that are threaded into transverse holes 74 and work to hold in members 54 and 56 within the grooves 64 or 66.

FIGS. 10 and 11 illustrate a jig 80 usable to facilitate drilling holes 72 and 70. As will be appreciated by reference to the figures, jig 80 can be formed from an extruded or machined length of bar stock having an inner plate 82 and an outer plate 84 parallel to each other and separated by a web 86 that serves as a fence. Thumb screws 88 threaded through holes 81 and 83 in outer plate 84 bear against box back 60 and lid 50 to hold jig 80 in position on the box members so that holes 70 and 72 may be drilled at 45 degree (or other appropriate) angles through back 60 and lid 50 a by passing the drill successively through each of the guide holes 90.

As will be appreciated by reference to the drawings and the preceeding description, numerous modifications can be made in this invention without departing from the spirit of the invention or the scope of the following claims.

What is claimed is:

1. A box hinge, comprising:

two hinge members, each comprising a cylinder having a longitudinal axis that lies in the same plane as the longitudinal axis of the other cylinder, an end with at least a portion of a dome formed thereon, and a planar face penetrated by a blind bore and a pin captured between the hinge members in the blind bores, wherein the hinge members are identical and the faces of the planar faces penetrated by blind bores parallel the longitudinal axes of the hinge members, and the hinge members rotate about the sequestered pin on an axis normal to the longitudinal axes.

2. A The hinge of claim 1, wherein each hinge member has at least one annular recess for receiving adhesive during installation.

3. The hinge of claim 1, wherein the dome has a diameter, the cylinders have a diameter and the diameter of the dome is slightly less than the diameter of the cylinders to create an optical alignment line on each cylinder.

4. A box hinge, comprising:

two hinge members, each comprising a cylinder having a longitudinal axis, an end with at least a portion of a dome formed thereon, and a planar face penetrated by a blind bore and a pin captured between the hinge members in the blind bores, wherein the hinge members are identical, the faces of the planar faces penetrated by blind bores parallel the longitudinal axes of the hinge members, and the hinge members rotate about the sequestered pin on an axis normal to the longitudinal axes, and each hinge member is penetrated by at least one transverse hole for receiving adhesive during installation.

5. The hinge of claim 4, wherein each hinge member is penetrated by at least one longitudinal hole communicating with the transverse hole.

6. A box hinge, comprising:

two hinge members, each comprising a cylinder having a longitudinal axis, an end with at least a portion of a dome formed thereon, and a planar face penetrated by a blind bore and at least one pin captured between hinge components in blind bores in such components, at least one of which components is one of the two hinge members, wherein the planar faces are normal to the longitudinal axes of the hinge members, the blind bores are coaxial with the longitudinal axes, and the hinge members rotate about the sequestered pin on the longitudinal axes, and each of the hinge members is penetrated by a hole threaded to receive a screw for securing the hinge member to a box or other component.

7. A box hinge, comprising:

two hinge members, each comprising a cylinder having a longitudinal axis, an end with at least a portion of a dome formed thereon, and a planar face penetrated by a blind bore and at least one pin captured between hinge components in blind bores in such components, at least one of which components is one of the two hinge members, wherein the planar faces are normal to the longitudinal axes of the hinge members, the blind bores are coaxial with the longitudinal axes, the hinge members rotate about the sequestered pin on the longitudinal axes, and further comprising a third hinge member comprising a cylinder having a longitudinal axis and two ends normal to the longitudinal axis of the third member and blind bores coaxial with the third member longitudinal axis for receiving the two sequestered pins, one of which pins is captured between the third hinge member and one of the two hinge members, and the other of which pins is captured between the third hinge member and the other of the two hinge members.

* * * * *